United States Patent [19]

Palka et al.

[11] 4,023,872

[45] May 17, 1977

[54] CABINET

[75] Inventors: James J. Palka, Arlington Heights; Michael V. Rutkovsky, West Chicago, both of Ill.

[73] Assignee: General Bathroom Products Corporation, Grove Village, Ill.

[22] Filed: Apr. 15, 1976

[21] Appl. No.: 677,330

[52] U.S. Cl. ..... 312/226; 16/191; 312/245

[51] Int. Cl.[2] ..... E05D 11/06

[58] Field of Search ..... 16/139, 147, 171, 177, 16/191; 312/224–227, 245

[56] References Cited

UNITED STATES PATENTS

| | | | |
|---|---|---|---|
| 2,778,053 | 1/1957 | Hess et al. | 16/171 |
| 3,298,764 | 1/1967 | Goldfarb | 312/227 |
| 3,311,946 | 4/1967 | Crankshaw | 16/191 |
| 3,506,326 | 4/1970 | Tontillo | 312/227 |
| 3,531,824 | 10/1970 | Hagendoorn et al. | 16/191 |

*Primary Examiner*—Casmir A. Nunberg
*Attorney, Agent, or Firm*—Rummler & Snow

[57] ABSTRACT

A one piece, lightweight, molded bathroom cabinet positioned above the washbowl which may be either installed on the wall surface or may be recessed in the wall. The mirrored doors are pivotally mounted interiorly of the marginal edges of the face of the cabinet and may be readily removed.

5 Claims, 15 Drawing Figures

FIG. 10
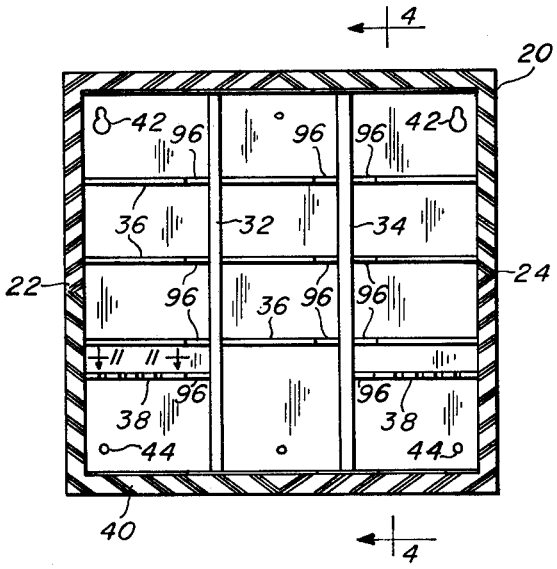
FIG. 4
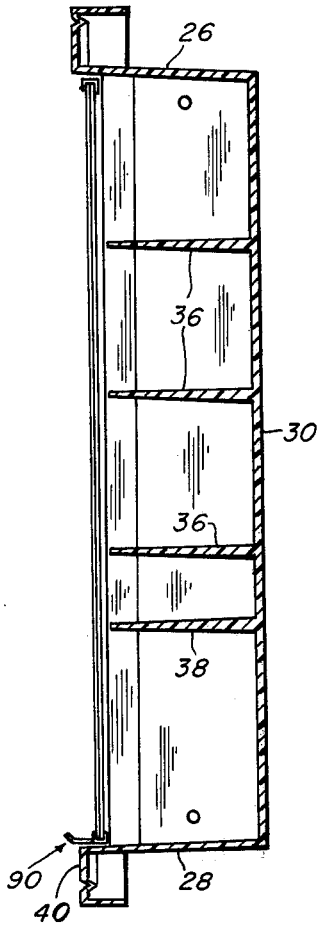
FIG. 8
FIG. 15
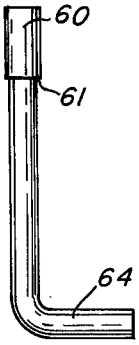
FIG. 9
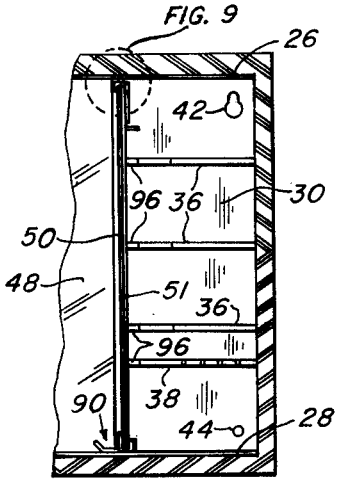
FIG. 11
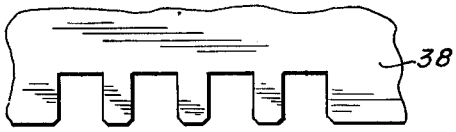
FIG. 9
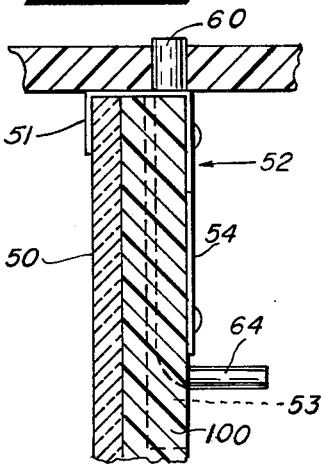

CABINET

BACKGROUND OF THE INVENTION

Most cabinets of this type are made of sheet metal, have removable shelves and doors permanently anchored by piano hinges. The entire cabinet is usually sprayed with enamel and baked. In a few years, the enamel is chipped and rust spots begin to appear due to the humidity in bathrooms and the cabinets become unsightly.

SUMMARY OF THE INVENTION

A lightweight cabinet body normally placed over the washbowl in the bathrooms of one piece, molded construction having built-in shelving and toothbrush holders. The multi-mirrored faced doors closures are removably positioned in the interior margins of the front of the cabinet with pivoted upper and lower door fastenings in the cabinet body and positive means for positioning the mirrors in open and closed positions. The cabinet body is encompassed on the front face with an ornamental frame molded simultaneously with the cabinet body.

BRIEF DESCRIPTION OF THE DRAWINGS

FIG. 4 is a vertical cross-sectional view taken on lines 4—4 of FIG. 1;

FIG. 8 is a partial front elevational view of one of the doors in open position with parts broken away;

FIG. 9 is a cross-sectional view of one of the doors as shown in the circled portion of FIG. 8;

FIG. 10 is a front elevational view of the cabinet body with doors removed;

FIG. 11 is a elevational view taken on the lines 11—11 of FIG. 10, with parts broken away;

FIG. 15 is a side elevational view of the shiftable pivot rod.

DETAILED DESCRIPTION OF THE DRAWINGS

Figure 1:
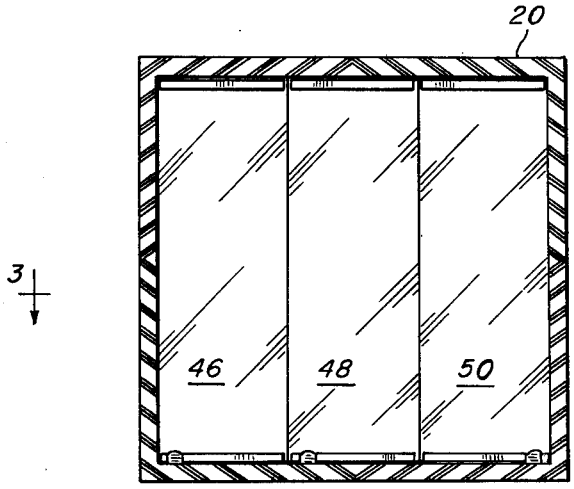
FIG. 1 is a front elevational view of the cabinet of the present invention.
Figure 2:
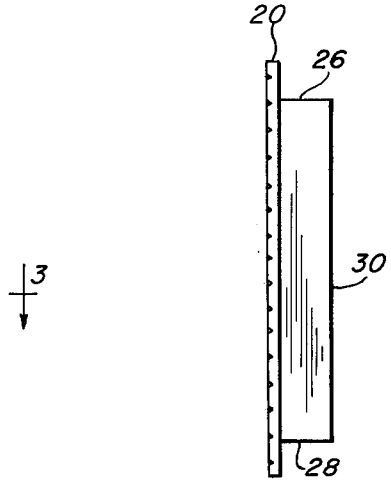
FIG. 2 is a side elevational view of the same.

The cabinet body 20 of the present invention is molded in one piece and comprises side walls 22, 24, top and bottom walls 26, 28 and rear wall 30 with a pair of strengthening and dividing inner walls 32, 34. A series of spaced, horizontally positioned shelves 36 are simultaneously molded interiorly of the cabinet body as is the toothbrush holder shelf 38.

Also simultaneously molded around the margins of the cabinet body 20 is a frame 40 which extends outwardly from walls 22, 24, 26 and 28, as shown in the drawings. The frame 40 may have ornamentation thereon and may take any shape according to the die used.

Since all the foregoing is molded in a single mold, it should be apparent that the cabinet body is very light in weight and can be molded in various colors.

It is to be appreciated that the depth of the cabinet body is of conventional size whereby to be seated in a recess in the bathroom wall. Suitable screw holes are provided in the side walls 22, 24 whereby the cabinet body may be secured to the wall studs. To hang the cabinet box to the surface of a wall, suitable keyhole slots 42 are provided in the rear wall 30. Round headed screws are positioned in the wall surface and the heads extend through the keyhole slot to support the cabinet body. Extra apertures 44 are provided in the lower ends of the rear wall 30 of the cabinet body 20 through which appropriate screws are inserted to anchor the lower end of the cabinet body to the wall surface.

In the embodiment shown in the drawings, three mirrored doors 46, 48, 50 are provided to appropriately seat in the free front margins of the side, end, top and bottom walls 22, 24, 26, 28, respectively.

Figure 5:
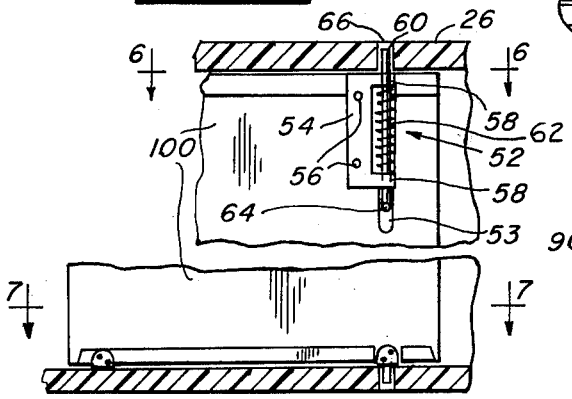
FIG. 5 is a rear elevational view of one of the mirror doors, with parts broken away and parts in section.
Figure 6:
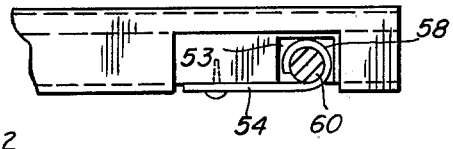
FIG. 6 is a cross-sectional view taken on lines 6—6 of FIG. 5.
Figure 7:
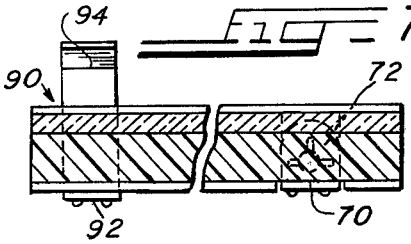
FIG. 7 is a cross-sectional view taken on lines 7—7 of FIG. 5.

Each door is provided at its upper end, adjacent one edge, with a groove 53 whereby to seat a spring pivot latch 52, as shown in FIGS. 5, 6 and 9. This latch comprises a plate 54 appropriately anchored to the rear face of the door by screws 56. The plate 54 has a pair of ears 58, 59 bent downwardly and inwardly, as shown in FIG. 6, in which ears the latch pivot pin or rod 60 extends upwardly and downwardly. A spring 62 seats at one end to the upper face of the lower ear 59 and encompasses the pin or rod 60 with the upper end abutting the stepped portion 61 of rod 60. (See FIG. 15.) Thus the rod 60 is always urged in an upwardly direction. The lower end of rod 58 is bent at right angles to form a handle 64. An aperture 66 is positioned in the top wall in alignment with the upper end of rod 60 whereby the upper end of rod 66 seats therein.

Figure 13:
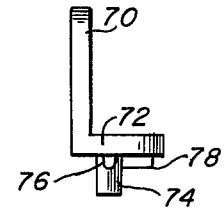
FIG. 13 is a side elevational view of the device of FIG. 12.
Figure 12:
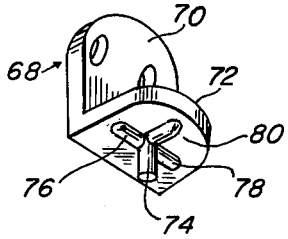
FIG. 12 is a perspective view of the lower door pivot.
Figure 3:
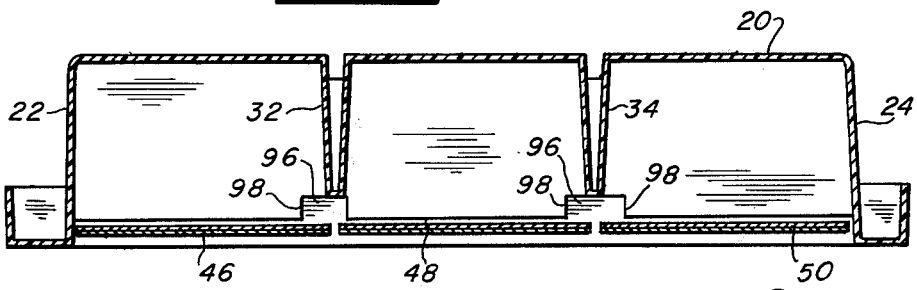
FIG. 3 is a cross-sectional view taken on lines 3—3 of FIG. 1.

Each door is also provided with a right angled plastic bracket 68. (see FIGS. 12 and 13.) One leg 70 is provided with spaced apertures for the reception of screws to anchor the leg 70 to the lower end of the rear face of the door adjacent one edge, as shown in FIGS. 5 and 6. The other leg 72 has a stem 74 extending downwardly from the lower face leg 72 and extends below the lower edge of the door. The stem is in alignment with pin 60. The lower face of leg 72 is also provided with three bars 76, 78, 80 having rounded faces, as seen in FIGS. 12, 13. One leg 80 extends in the same direction as the leg 72 while legs 76 and 78 extend at right angles to the leg 80 and all about the stem 74, as clearly shown in FIG. 12.

Figure 14:
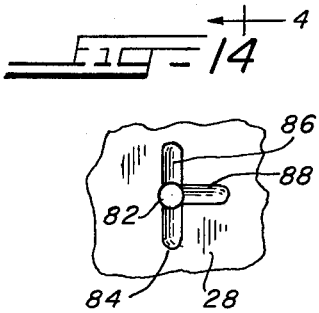
FIG. 14 is a fragmental view showing slots in the bottom of the cabinet body.

As shown in FIG. 14, an aperture 82 is provided in the bottom wall 28 and is in alignment with the aperture 66 in the top wall 26. Also grooves 84, 86, 88 are provided in the bottom wall 28 about the aperture 82 for seating the bars 76, 78 and 80, respectively, as will hereinafter be explained.

To secure a door to the cabinet body, the stem 74 is first inserted in aperture 82. Then the handle is shifted downwardly and the upper end of rod 60 is inserted in aperture 66 by releasing the handle 64. When the door is in closed position, the bars 76, 78 will seat in grooves 86, 84 and retain the door in such closed position. When the door is in open position at right angles to the closed position, the bar 80 will seat in groove 88 to retain the door in such position.

Each door is provided with a plastic door pull 90 which has a leg 92 secured to the lower end of the innerface of the door by appropriate screws. The other leg 94 extends at right angles to the leg 92 and below the lower edge of the door and outwardly and upwardly, as clearly shown in FIG. 8. Each door pull 90 is positioned on the door opposite the bracket 68.

It is to be especially noted that the reinforcing ribs 32, 34 and shelving 36 are provided with cutouts 96 whereby to allow the edges of the doors having the pivot pins 66 and stems 74 to project into the cabinet body, as the doors are mounted in the margin of the top, bottom and side walls and clearance is thus provided. The edges 98 of the cutouts 96 also provide a stop for the doors in the event of careless opening beyond intended opening thereof.

Also, the upper and lower ends of each door are provided with U-shaped, elongated, polished aluminum members 51 to support the mirror on the plastic backing 100 by suitable fastening means while the mirror is secured to the backing 100 by double stick tape.

To remove a door from the cabinet body, the handle 64 is pulled downwardly thus releasing the rod 60 from its aperture seat 66. Now the door is removed by using an outward and upward motion to release the stem 74 from its aperture 82. To restore the door to the cabinet body, the stem 74 is inserted in its aperture seat 82 and the handle 64 shifted downwardly to allow the door to be inserted below the frame 40, and releasing the handle so the spring 62 will force the upper end of the rod 60 to seat in aperture 66.

Although but one specific embodiment of this invention is herein shown and described, it will be understood that details of the construction shown may be altered or omitted without departing from the spirit of the invention as defined by the following claims.

We claim:

1. A lightweight cabinet for bathrooms comprising a one piece, molded cabinet body having an ornamental frame surrounding the face of said body and having top, bottom, side and rear walls with integrally formed spaced shelving provided interiorly in the body, a plurality of removable mirrored doors pivotally secured in the margins of said body each capable of opening independently of the others, means for opening and closing each of said doors, and means for positively positioning the doors in open and closed position.

2. The device according to claim 1 wherein said pivots on said doors are spaced and are located adjacent one side edge of each of said mirrored doors and on the rear face thereof, each comprising an upper, spring loaded, shiftable rod positioned adjacent the upper margin of the door with a portion extending above said door and having a handle member on the lower end of said rod and a plastic bracket positioned adjacent the lower margin of said door and having a depending stem extending below said door, said rod pivot and said stem being aligned, aligned apertures one in said top wall and one in said bottom wall to receive said stem and the upper portion of said rod, whereby the hinges are completely hidden when the doors are in closed position, said bracket provided with a vertically extending leg for anchoring to the lower margin of the door and a right angled, horizontally extending leg, said latter leg having an upper and lower face, a plurality of bars molded integrally on said lower face and extending outwardly from said stem, one of said bars extending at right angles to said upper leg and two lying in a plane normal to said one bar, and a T-shaped groove in said bottom wall for seating said bars, whereby said mirrored doors are automatically retained in either open or closed position.

3. The device according to claim 2 wherein said means for opening each of said doors comprises a plastic, right angled bracket having a vertically disposed leg secured to the rear face of said door, a horizontal leg extending below said door and outwardly of the front face of said door and a portion terminating upwardly and outwardly.

4. The device according to claim 1 wherein the plurality of mirrored doors are three in number and are all capable of being opened and closed independently of each other.

5. The device according to claim 2 wherein the plurality of mirrored doors are three in number and are all capable of being opened and closed independently of each other.

* * * * *

UNITED STATES PATENT OFFICE
CERTIFICATE OF CORRECTION

PATENT NO. : 4,023,872
DATED : May 17, 1977
INVENTOR(S) : James J. Palka et al.

It is certified that error appears in the above-identified patent and that said Letters Patent are hereby corrected as shown below:

The assignee's address is shown as "Grove Village" whereas it should be "Elk Grove Village"

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*